US008739337B1

(12) United States Patent
Sanders et al.

(10) Patent No.: US 8,739,337 B1
(45) Date of Patent: Jun. 3, 2014

(54) PATIENT SELF-TRANSFER SYSTEM

(76) Inventors: James R. Sanders, Amarillo, TX (US); C. Duane Sanders, Amarillo, TX (US)

( * ) Notice: Subject to any disclaimer, the term of this patent is extended or adjusted under 35 U.S.C. 154(b) by 190 days.

(21) Appl. No.: 13/507,731

(22) Filed: Jul. 25, 2012

(51) Int. Cl.
*A61G 7/053* (2006.01)

(52) U.S. Cl.
CPC ..... *A61G 7/0536* (2013.01)
USPC ..... 5/662; 5/81.1 R; 5/658

(58) Field of Classification Search
CPC ..... A61G 7/053; A61G 7/0536
USPC ..... 5/81.1 R, 83.1, 84.1, 89.1, 424, 658, 5/659, 662
See application file for complete search history.

(56) References Cited

U.S. PATENT DOCUMENTS

| | | | | |
|---|---|---|---|---|
| 908,845 | A * | 1/1909 | Curtin | 5/662 |
| 2,927,329 | A * | 3/1960 | Johannis | 5/662 |
| 4,611,804 | A * | 9/1986 | Addair | 482/131 |
| 4,679,265 | A * | 7/1987 | Wicks | 5/662 |
| 5,375,280 | A * | 12/1994 | O'Sullivan et al. | 5/662 |
| 5,787,530 | A * | 8/1998 | Brix | 5/662 |
| 6,276,007 | B1 * | 8/2001 | Brown | 5/81.1 R |
| 6,658,676 | B1 * | 12/2003 | Persson et al. | 5/81.1 HS |
| 7,020,920 | B2 * | 4/2006 | Armstrong | 5/662 |
| 7,340,787 | B1 * | 3/2008 | Willard et al. | 5/662 |

* cited by examiner

*Primary Examiner* — Michael Trettel
(74) *Attorney, Agent, or Firm* — Norman B. Rainer

(57) ABSTRACT

A system of belt and buckle components enable a handicapped person to achieve self-transfer between a bed and contiguous wheelchair. One extremity of the belt is secured to the wheelchair, and the other extremity of the belt is anchored to a panel inserted beneath the bed at a site transversely opposite the wheelchair.

8 Claims, 2 Drawing Sheets

PATIENT SELF-TRANSFER SYSTEM

BACKGROUND OF THE INVENTION

1. Field of the Invention

This invention concerns a system for enabling a handicapped person to transfer unaidedly between a bed and a wheelchair.

2. Description of the Prior Art

Mechanized systems have earlier been disclosed for transferring a patient between a bed and wheelchair. Such systems utilize motors and interactive electrical controls to move the patient in a customized manner consistent with the particular nature of the patient's disability. Not only are such systems very expensive, but they mandate that the patient never leave the building in which the system is installed.

U.S. Pat. No. 3,927,430 to Ira Allen discloses a substantially portable self-transfer system comprised of a rigid panel upon which the patient can slide himself between his bed and wheelchair. However, Allen's system can only be utilized by patients who can push against the floor with their feet to traverse the gap between the bed and wheelchair.

It is accordingly the primary object of this invention to provide a non-motorized apparatus system for enabling a person having reasonably normal upper torso and arm strength to achieve self-transfer between a bed and wheelchair.

It is another object of the present invention to provide a system as in the foregoing object which does not require permanent installation into the room in which said bed is located.

It is a further object of this invention to provide a system of the aforesaid nature which is reasonably portable.

It is yet another object of the present invention to provide a system of the aforesaid nature which can be adjusted to accommodate the specific needs of the user.

These objects and other objects and advantages of the invention will be apparent from the following description.

SUMMARY OF THE INVENTION

The above and other beneficial objects and advantages are accomplished in accordance with the present invention by a system of components which enable a handicapped person having reasonably normal upper torso and arm strength to achieve self-transfer between a bed and wheelchair, said bed comprising a conventional mattress and underlying box-spring unit, and being of rectangular shape having head and foot extremities and opposed sides, said components comprising:

a) a wheelchair securing assembly comprising a first buckle component and first compliant belt adapted to be installed onto a wheelchair to enable said wheelchair to be drawn tightly against that side of said mattress where said transfer is intended, b) a second compliant belt of adjustable effective length extending between a first extremity adapted to releasibly engage said first buckle component and a second extremity interactive with a third compliant belt, and c) anchoring means in the form of a substantially rigid elongated flat structure adapted to be slideably inserted between said mattress and box spring unit at the side of said mattress opposite said transfer side and engageable by said third belt, and d) a rigid control staff adapted to be grasped by one hand of said person and forced downwardly upon the upper surface of said mattress, thereby lifting the person 3 to 4 inches above said mattress to facilitate transfer to said wheelchair.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
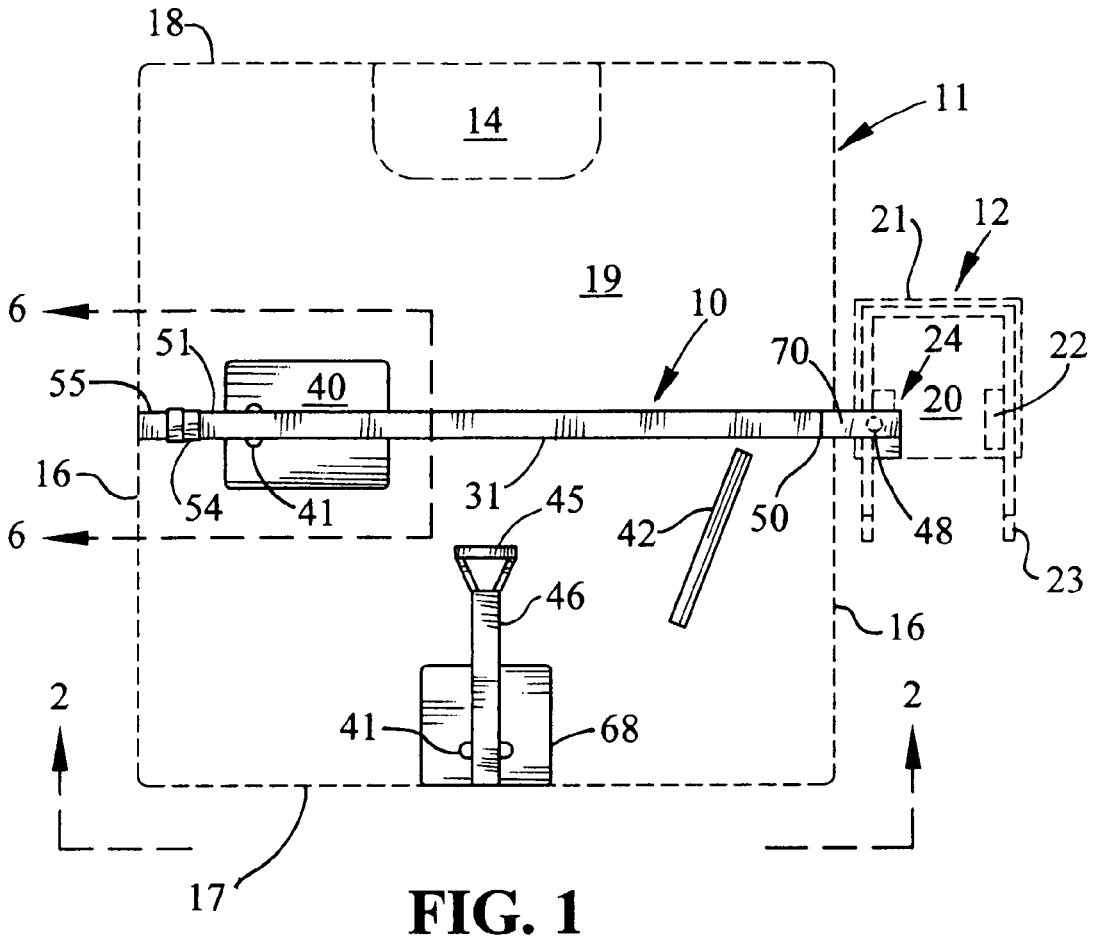
FIG. 1 is a top view showing the components of the self-transfer system of this invention in association with a commonplace bed and wheelchair.
Figure 2:
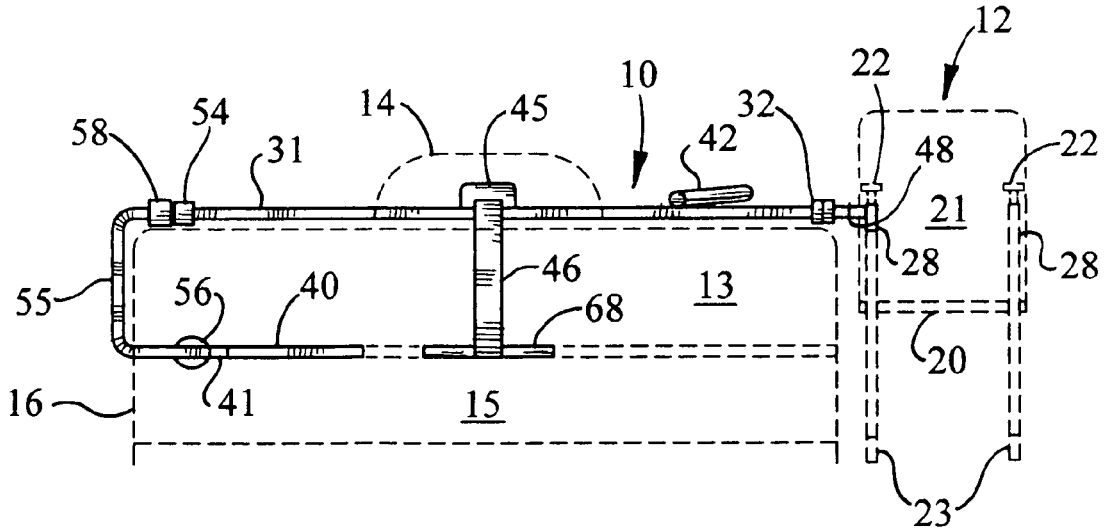
FIG. 2 is an end view taken in the direction of the arrows upon the line 2-2 of FIG. 1.
Figure 3:
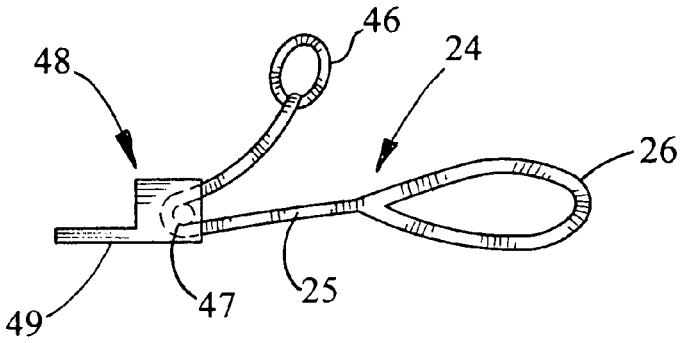
FIG. 3 is an enlarged perspective view of a wheelchair securing assembly component.
Figure 4:
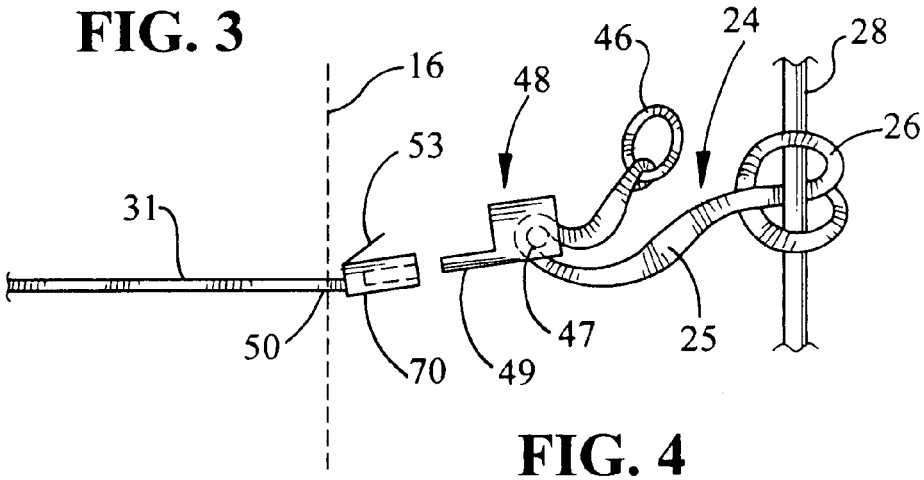
FIG. 4 is a view of said wheelchair securing assembly in interactive relationship with a wheelchair.
Figure 6:
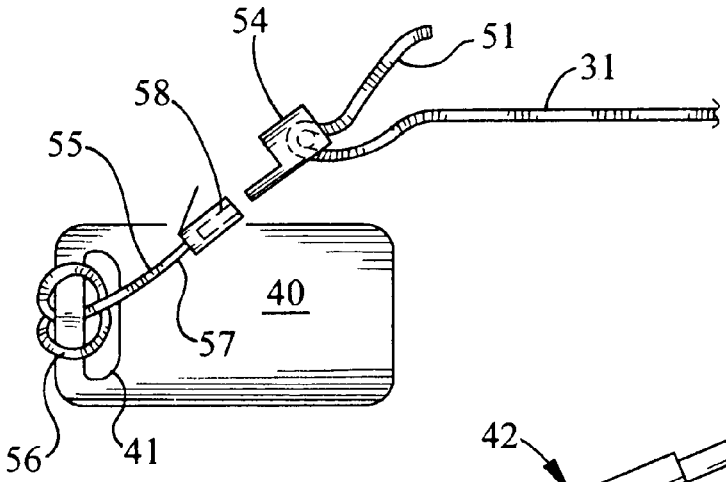
FIG. 6 is an enlarged fragmentary perspective view of the region of FIG. 1 designated by arrowed lines 6-6.

Referring now to FIGS. 1-4, an embodiment of the self-transfer system 10 of the present invention is shown in association with a bed 11 and wheelchair 12.

Bed 11 is compromised of a mattress 13 having a substantially flat upper surface 19 upon which a pillow 14 may be placed, and an underlying box spring unit 15. Said mattress and box spring unit are of rectangular configuration, having congruent sides 16 and foot and head extremities 17 and 18, respectively.

Wheelchair 12 may be either a wheelchair for general use indoors or outdoors, or a specialized wheelchair intended for bathroom use. Said wheelchair is typically comprised of a seating panel 20, back panel 21, paired arm rests 22 supported by posts 28, and paired wheels 23.

A wheelchair securing assembly 24 is employed having a compliant belt 25 with a loop 26 at one extremity and a pull ring 46 at the opposite extremity. At an intervening site between said extremities, belt 25 is caused to pass in a 180° path around a snugging roller 47 pivotably held within first male buckle component 48 having a forwardly directed flat connector lip 49. The manner of installing assembly 24 is shown are in FIG. 4 wherein belt 25 and associated buckle component 48 are caused to pass through loop 26 in a manner to embrace a post 28 of said wheelchair. In an alternative embodiment, loop 26 may be replaced by VELCRO hook and loop fastening material adapted to embrace post 28.

A compliant flat securement belt 31 extends between first and second extremities 50 and 51, respectively. Said first extremity is fixedly attached to first female buckle component 70 which contains latching means for releasibly receiving connector lip 49 of said first male buckle component 48. The detailed construction of said buckle component is of commonplace design, and is disclosed for example in U.S. Pat. No. 4,675,956 which is incorporated herein by reference. The mechanism for unlatching connector lip 49 is shown for convenience as release lever 53, but other release means, such as push buttons may be employed. The second extremity 51 of belt 31 is associated with second male buckle component 54, whose functionality is substantially the same as said first male buckle component 48.

A third belt 55 is provided having an anchoring loop 56, and an opposite extremity 57 having second female buckle component 58, identical to said first female buckle component 70, and adapted to interact with second male buckle component 54.

Anchoring means is provided in the form of a substantially rigid elongated flat panel 40 adapted to be slideably inserted between said mattress and box spring unit at the side of the mattress opposite said transfer site. Panel 40 is releasibly engageable by loop 56 of belt 55 wherein said loop is caused to penetrate an aperture 41 in panel 40 and then threadably receive extremity 57 which is pulled tautly through the loop. Panel 40 may have an extensively apertured configuration for the purpose of minimizing its weight yet retaining its functionality. In preferred embodiments, the panel may have a foldable hinged construction so as to occupy less storage space for travel. Panel 40 may be of rectangular or other contours, and is preferably fabricated of plastic having thicknesses between about ⅛ and ¼ inch. In an alternative embodiment, loop 56 may be replaced by VELCRO hook and loop fastening material adapted to penetrate aperture 41.

The several belts may be fabricated of non-extensible woven nylon belting as employed in automotive seat belts, and can be coiled into compact storage states. By virtue of the three aforesaid linearly interconnected belts and two interactive buckles whereby one extremity is anchored beneath the mattress and the other anchored to the wheelchair, the wheelchair is caused to be pulled tightly against the bed.

Figure 5:
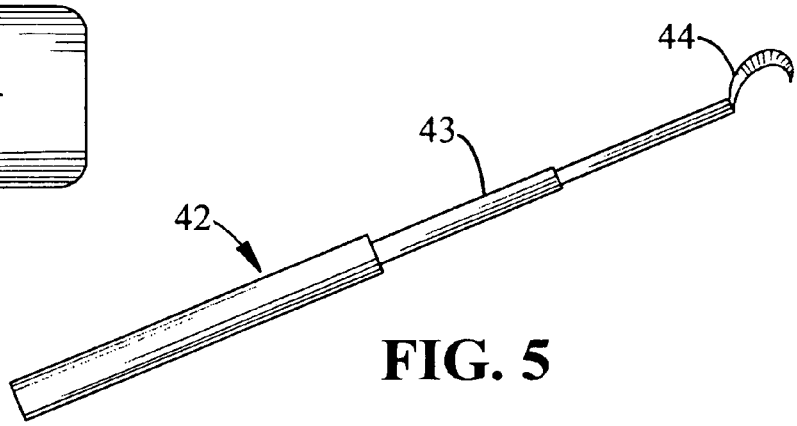
FIG. 5 is a side view of an alternative embodiment of the control staff component of the system of FIG. 1.

A rigid control staff component 42 having a diameter of 1 to 2 inches, a length of 25 to 35 inches, and a cushioned covering is adapted to be gripped at about midlength by one hand of the user and forced downwardly upon upper surface 19 of the mattress in a manner to assist movement toward said wheelchair. Such action also provides balance, and lifts the user about 3-4 inches above surface 19 in a seated position and over the top of wheel 23 of the wheelchair. Were it not for the use of control staff 42, the user, if merely pushing down upon the mattress with a single fisted hand, would not produce the necessary lifting action to complete the transfer. Instead, the fisted hand would merely penetrate several inches into the mattress. In a preferred embodiment, as shown in FIG. 5, the control staff is provided with an outwardly extendable telescopic portion 43. Such construction, which provides enhanced balance control in the seated position, is comparable to conventional monopods which are used with cameras, and is further disclosed in U.S. Pat. No. 7,096,530, incorporated herein by reference. The outermost tip of portion 43 may be provided with a hook 44. By virtue of such construction, the handicapped person is able to reach and manipulate items within the bedroom without leaving the bed.

In a further embodiment, a pulling handle 45 is added to the components of the system of this invention. Said handle is removably attached to an auxiliary belt 46 having a distal extremity that removably attaches to an auxiliary anchoring panel 68 having the same general construction and manner of use as anchoring panel 40. Said pulling handle enables the user to bring himself to a seated position in bed in preparation for movement toward said wheelchair.

While particular examples of the present invention have been shown and described, it is apparent that changes and modifications may be made therein without departing from the invention in its broadest aspects. The aim of the appended claims, therefore, is to cover all such changes and modifications as fall within the true, spirit and scope of the invention.

Having thus described our invention, what is claimed is:

1. A system of components which enable a handicapped person having reasonably normal upper torso and arm strength to achieve self-transfer between a bed and wheelchair, said bed comprising a conventional mattress and underlying box-spring unit, and being of rectangular shape having head and foot extremities and opposed sides, said components comprising:

a) a wheelchair securing assembly comprising a first buckle component and first compliant belt adapted to be installed onto a wheelchair to enable said wheelchair to be drawn tightly against that side of said mattress where said transfer is intended, b) a second compliant belt of adjustable effective length extending between a first extremity adapted to releasibly engage said first buckle component and a second extremity interactive by way of a second buckle component with a third compliant belt, and c) anchoring means in the form of a substantially rigid elongated flat structure adapted to be slideably inserted between said mattress and box spring unit at the side of said mattress opposite said transfer side and engageable by said third belt, and d) a rigid control staff adapted to be grasped by one hand of said person and forced downwardly upon the upper surface of said mattress to enable the person to push himself or herself toward the wheelchair, and also to lift the person 3 to 4 inches above said mattress to facilitate transfer to said wheelchair.

2. The system of claim 1 wherein each buckle component is comprised of separable male and female portions which are interlocking.

3. The system of claim 2 wherein each buckle component contains a latching feature which secures said male portion within said female portion.

4. The system of claim 3 wherein one of the portions of each buckle component contains a belt snugging feature which allows an adjustable length of said belt to be pulled through said buckle portion.

5. A kit comprised of the components of claim 1 in a reasonably compact form suitable for travel and installation upon a second bed at a distant location.

6. The system of claim 1 further having a fourth belt having at one extremity a handle adapted to be positioned atop said mattress to permit pulling by the person to achieve a sitting position preparatory to moving toward said wheelchair, and a second extremity of said fourth belt being interactive with an auxiliary anchoring means adapted to be slideably inserted between said mattress and box spring unit at the foot of said bed.

7. The system of claim 1 wherein said control staff is elongatable by way of telescopically interactive members contained within said staff and slideably emergent therefrom to extend to a distal extremity.

8. The system of claim 7 wherein said distal extremity of said telescopically extended control staff has a hook member adapted to enable the person to reach items while in bed.

* * * * *